US006880826B2

(12) United States Patent
Inoue

(10) Patent No.: US 6,880,826 B2
(45) **Date of Patent: *Apr. 19, 2005**

(54) SYMBOL DISPLAY APPARATUS FOR GAME MACHINE

(75) Inventor: Haruo Inoue, Tokyo (JP)

(73) Assignee: Dragon Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/338,655

(22) Filed: Jan. 9, 2003

(65) Prior Publication Data

US 2004/0026854 A1 Feb. 12, 2004

(30) Foreign Application Priority Data

Aug. 7, 2002 (JP) ..... 2002-229829

(51) Int. Cl.[7] ..... A63F 5/04
(52) U.S. Cl. ..... 273/143 R; 273/138 A
(58) Field of Search ..... 273/143 R, 138.2; 462/20

(56) References Cited

U.S. PATENT DOCUMENTS 3,910,582 A * 10/1975 Richards ..... 273/143 R
4,722,527 A * 2/1988 Gauselmann ..... 273/143 R
5,154,420 A * 10/1992 Gutknecht ..... 463/17
5,373,440 A * 12/1994 Cohen et al. ..... 705/14
5,395,111 A * 3/1995 Inoue ..... 273/143 R
5,722,891 A * 3/1998 Inoue ..... 463/20
5,749,576 A * 5/1998 Heinen et al. ..... 273/138.1
5,752,881 A * 5/1998 Inoue ..... 463/20
5,934,672 A * 8/1999 Sines et al. ..... 273/143 R
6,270,411 B1 * 8/2001 Gura et al. ..... 463/20
6,302,791 B1 * 10/2001 Frohm et al. ..... 463/21
6,311,976 B1 * 11/2001 Yoseloff et al. ..... 273/138.2
6,398,220 B1 * 6/2002 Inoue ..... 273/142 R
6,464,581 B1 * 10/2002 Yoseloff et al. ..... 463/20
6,533,273 B1 * 3/2003 Cole et al. ..... 273/138.1
6,645,073 B1 * 11/2003 Lemay et al. ..... 463/20
2003/0003979 A1 * 1/2003 Seelig et al. ..... 463/16
2003/0004786 A1 * 1/2003 Tokieda et al. ..... 705/10
2003/0232643 A1 * 12/2003 Inoue ..... 463/20
2004/0000754 A1 * 1/2004 Inoue ..... 273/143 R

FOREIGN PATENT DOCUMENTS

JP 6-238033 * 6/1994 ..... A63F/5/04

* cited by examiner

*Primary Examiner*—Gregory Vidovich
*Assistant Examiner*—Dolores R. Collins
(74) *Attorney, Agent, or Firm*—Young & Thompson

(57) ABSTRACT

A symbol display apparatus for game machine includes aligned plural reel units. Each of the reel units has double reel structure composed of an outer reel and an inner reel. Of two half symbols made by dividing a single complete symbol, one half symbol is disposed in a periphery of the inner reel, and the other half symbol is disposed in a periphery of the outer reel. When the corresponding half symbols disposed separately in the inner and outer reels stop together on the same winning line, a composite symbol is formed. The composite symbol is used as a hit symbol which makes up a winning symbol combination.

10 Claims, 9 Drawing Sheets

31
17
35
31
WT
WLD
WT
35
LD
BLE
17
32
32
34
14
15
16
17
WLD
BLE
WLD
WT 35
31
17
32
34
14
15
16
BLE
WLD
WL

SYMBOL DISPLAY APPARATUS FOR GAME MACHINE

BACKGROUND OF THE INVENTION

1. Field of the Invention

The present invention relates to a symbol display apparatus used for a game machine, such as a slot machine, an upright pinball machine, and the like.

2. Background Arts

Many game machines such as a slot machine, an upright pinball machine, and the like have a symbol display apparatus. As for the known symbol display apparatus for the game machine, for example, there are a mechanical reel type using reels each of which has plural types of symbols on outer periphery, and a video type displaying simulative reels on a CRT or a liquid crystal display based on graphic data stored on a ROM. These game machines decide a win or loss based on a combination of the symbols completed on a winning line across a symbol display window in stopping the reels.

Whether a winning symbol combination is completed or not is a prime concern of a player, so it is important to arrange various types of symbol combinations for the sake of raising a player's interest in a game. In the mechanical reel type, it is difficult to increase the types and the number of symbols arranged in each reel. So, a symbol display apparatus with a double reel structure is used. This apparatus has at least one reel unit that is composed of an outer reel and an inner reel rotating concentrically and independently each other. The symbol display apparatus with the double reel structure gives variety to the symbol combinations, because each reel unit can carry more types and numbers of symbols.

There is a known way to excite the player's interest in which the winning symbol combination is almost completed up to becoming a riichi situation, and then the last reel makes the game result in loss. The riichi situation is a situation where only a single reel to stop last is still rotating, and where a winning symbol combination will be completed if the last reel displays an objective symbol. In this case, the objective symbol in the last reel slips off the winning line on which the winning symbol combination is almost completed, and stops on another winning line upper or lower thereof. A sense of expectations and near miss originating from this way raises player's excitement to the game.

However, this way has a disadvantage in that the player's expectations for the win decrease according as frequency of the near miss increases, so the game tends to be monotonous.

SUMMARY OF THE INVENTION

An object of the present invention is to provide a symbol display apparatus which can raise a player's expectations for a win, by taking advantage of characteristics of double reel structure.

To achieve the above object, a symbol display apparatus according to the present invention includes plural reel units aligned across a winning line. At least one of the reel units has double reel structure which is composed of an inner reel and an outer reel rotating concentrically and independently each other. Dividing one complete symbol forms two half symbols. The first half symbol is disposed in a periphery of the inner reel, and the second half symbol is disposed in a periphery of the outer reel. When the inner and outer reels stop and the first and second half symbols are overlapped each other on the same winning line, the two half symbols form a composite symbol.

The individual half symbol is a lost symbol which does not make up any winning symbol combination, but the composite symbol formed by the half symbols is a hit symbol which makes up the winning symbol combination.

When a game starts, only one of the inner or outer reel of each reel unit rotates and stops, so the first display condition appears in a symbol display window. The first display condition is, for example, a symbol pattern including the half symbol. Then the other reel rotates and stops too, so the second display condition appears. The second display condition includes, for example, the composite symbol which is formed by overlapping the half symbol in the first display condition with the corresponding half symbol. In the second display condition, the composite symbol and complete symbols make up a symbol combination on the winning line. A win or loss is decided based on the second display condition.

According to the present invention, since a display condition is varied during a single game, it is possible to raise player's expectations for completion of the winning symbol combination.

Also each of the first and second half symbols has an overlap area. When the first and second half symbols form the composite symbol, both the overlap areas are overlapped each other in order to prevent appearance of a gap between the first and second half symbols. Therefore, it is possible to form the composite symbol in good appearance.

BRIEF DESCRIPTION OF THE DRAWINGS

The above and other objects and advantages of the present invention will become apparent from the following detailed description of the preferred embodiment when read in association with the accompanying drawings, which are given by way of illustration only and thus are not limiting the present invention. In the drawings, same reference numerals designate like or corresponding parts throughout the several views, and wherein.

DETAILED DESCRIPTION OF THE EMBODIMENTS

Figure 1:
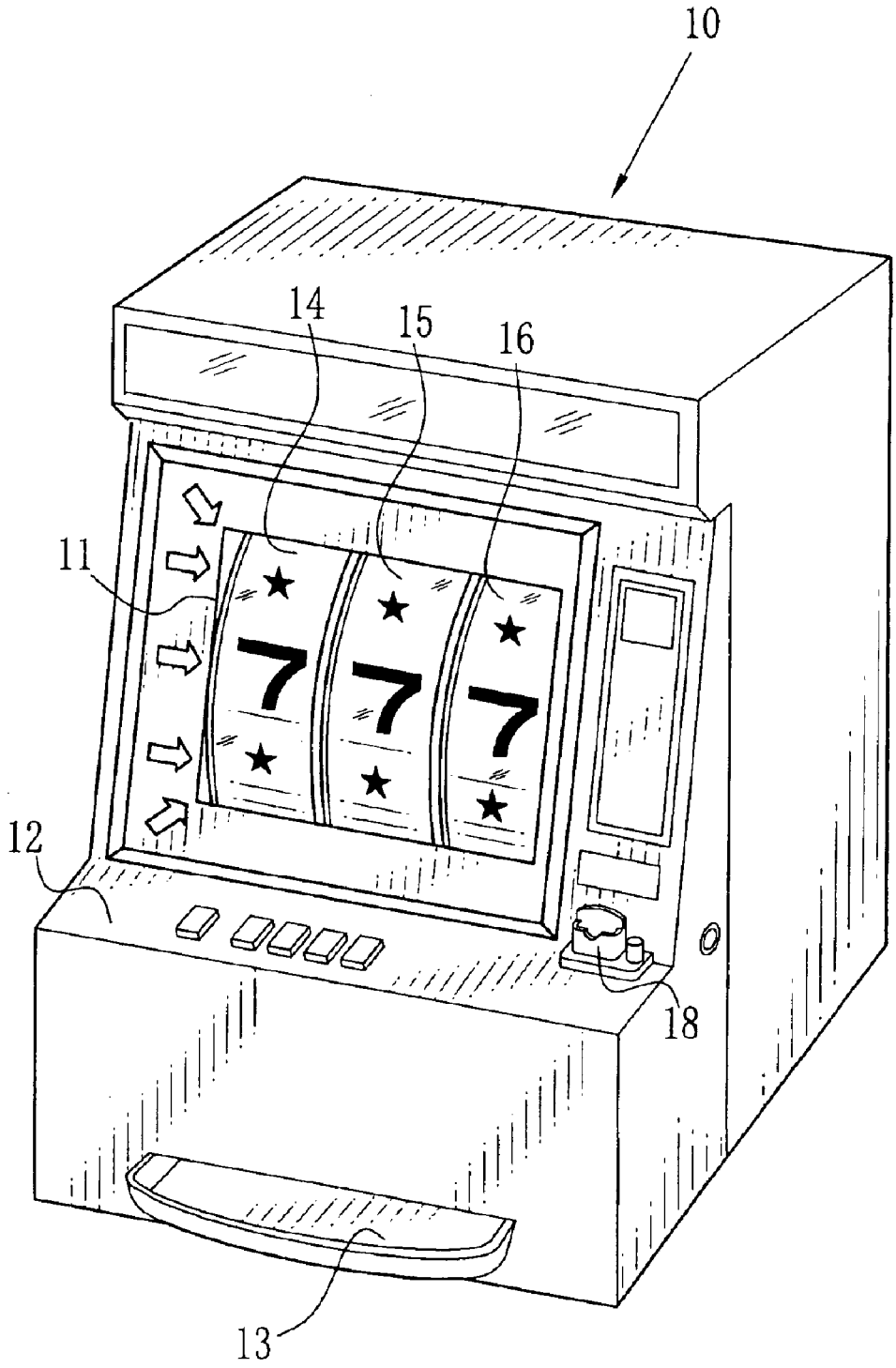
FIG. 1 is a front perspective view of a slot machine with a symbol display apparatus.

Referring to FIG. 1, there is provided a symbol display window 11 in a front panel of a slot machine 10. An operation panel 12 and an outlet 13 are provided below the symbol display window 11. Inside the symbol display window 11, is disposed a symbol display apparatus including the first, second, and third reel units 14 to 16. When the first, second, and third reel units 14 to 16 stop, three symbols per a reel unit are observable through the display window 11.

Figure 2:
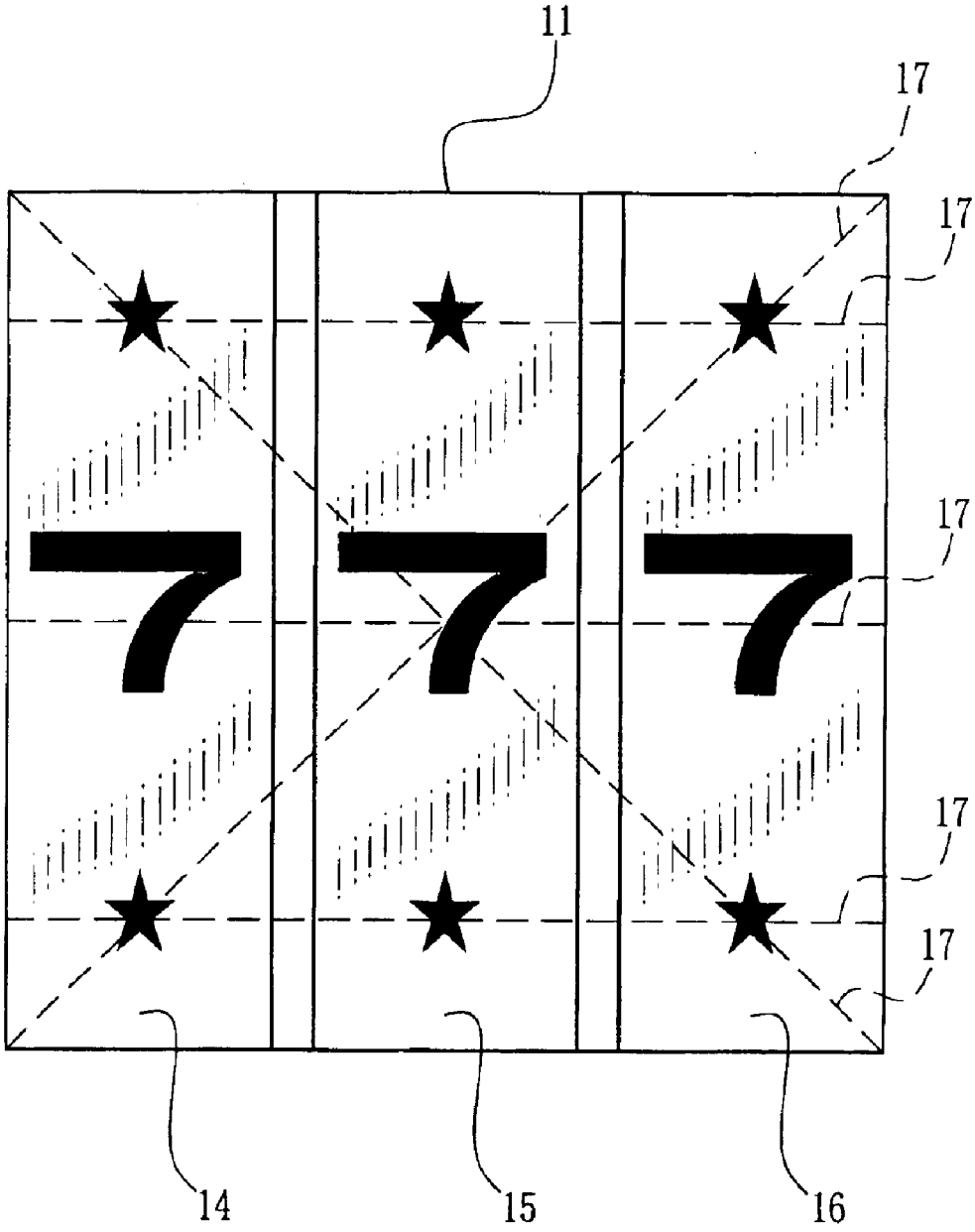
FIG. 2 is a front view of the symbol display apparatus.

Referring to FIG. 2, there are five winning lines 17 (shown by broken line) which consist of three horizontal and two oblique lines across the symbol display window 11. The number of the effective winning lines increases in accordance with the number of bet coins. A player bets the coins by means of operating a bet button provided in the operation panel 12 after insertion of the coins into a coin slot 18. The coins counted by a credit counter are also usable for bet, besides the coins actually inserted into the coin slot 18.

The operation panel 12 has a payout button, a game start button, and the like, besides the bet button. When the game start button is operated after the bet, the first, second, and third reel units 14 to 16 start rotating and show symbols moving downward. Result of a game is decided according to a symbol combination displayed along the effective winning lines 17 when all reel units 14 to 16 stop. When a win is obtained, prize coins are paid out the number of which is predetermined in accordance with a type of symbol combinations.

Figure 3:
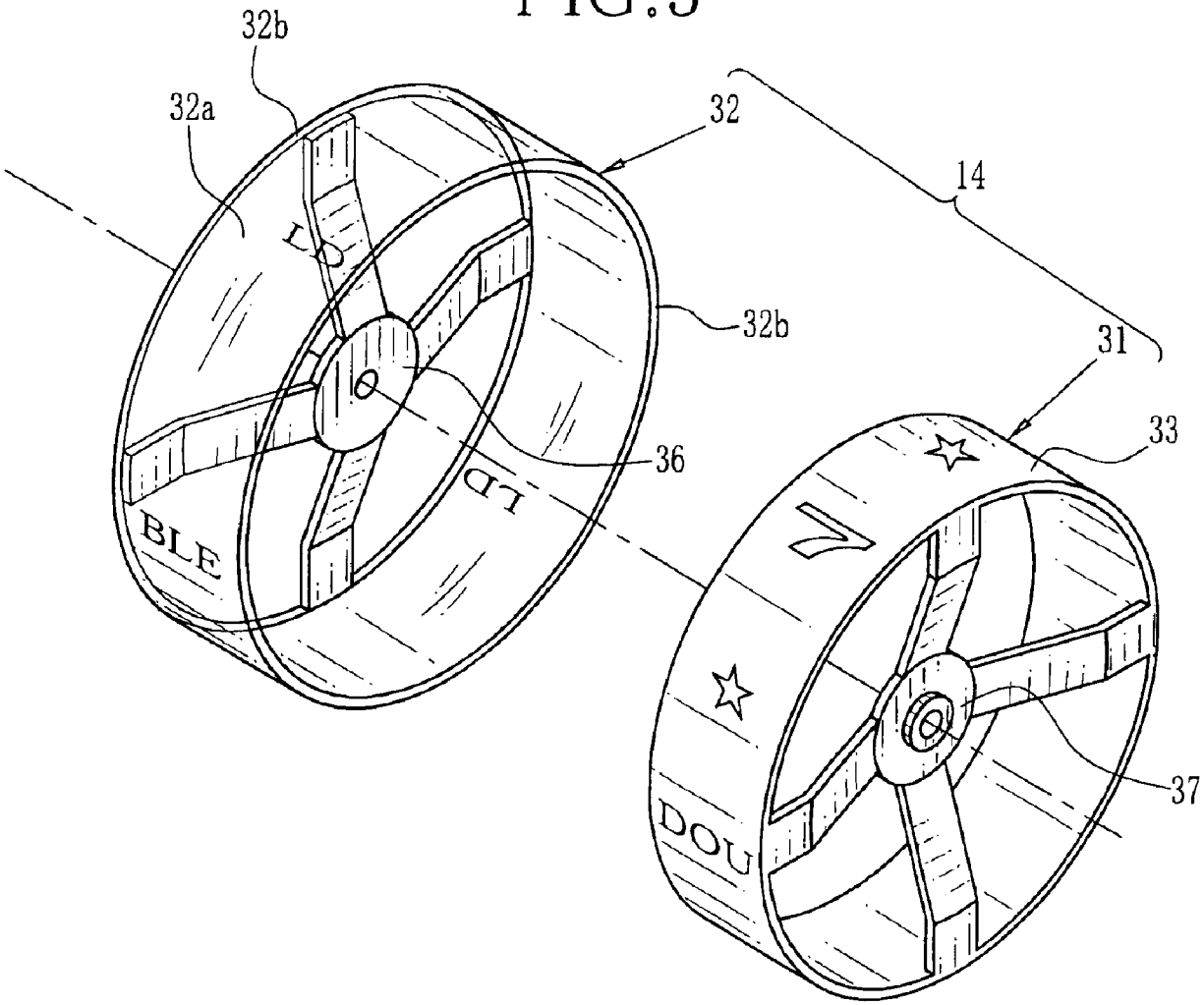
FIG. 3 is a perspective view of an inner reel and an outer reel.

Referring to FIG. 3, each of the first, second, and third reel units 14 to 16 is composed of an outer reel 32 and an inner reel 31 concentrically disposed inside the outer reel 32. The inner reel 31 rotates in all games, but the outer reel 32 rotates only when winning in a outer reel rotation decision lottery drawn in each game. Now structure of the reel unit will be described with taking the first reel unit 14 as an example, because all reel units 14 to 16 have the same structure.

The inner reel 31 is made of durable and opaque plastic, and an outer periphery thereof is wrapped in an inner symbol sheet 33. The outer reel 32 is made of transparent plastic, and includes two round-shaped frames 32*b* and a transparent outer symbol sheet 32*a* wrapped around an outer periphery thereof. Symbols in the inner reel 31 are observable through the transparent outer symbol sheet 32*a*.

Figure 4A:
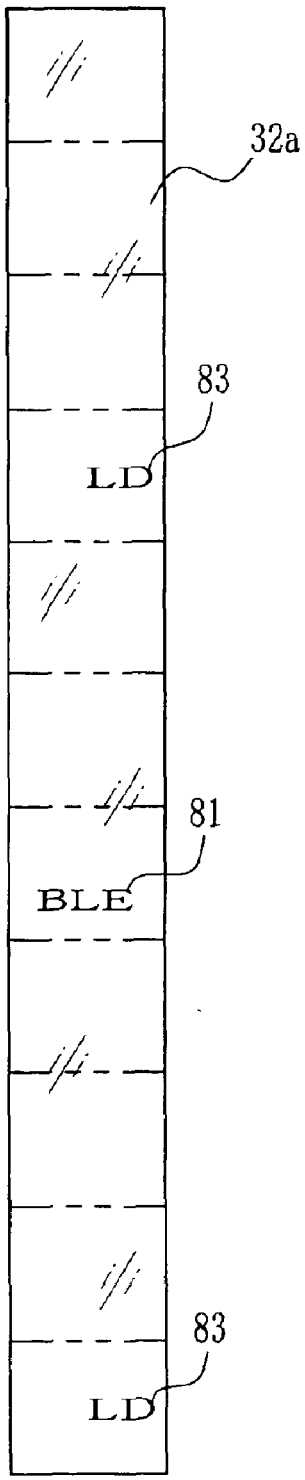
FIG. 4A is an expansion view of an outer symbol sheet.
Figure 4B:
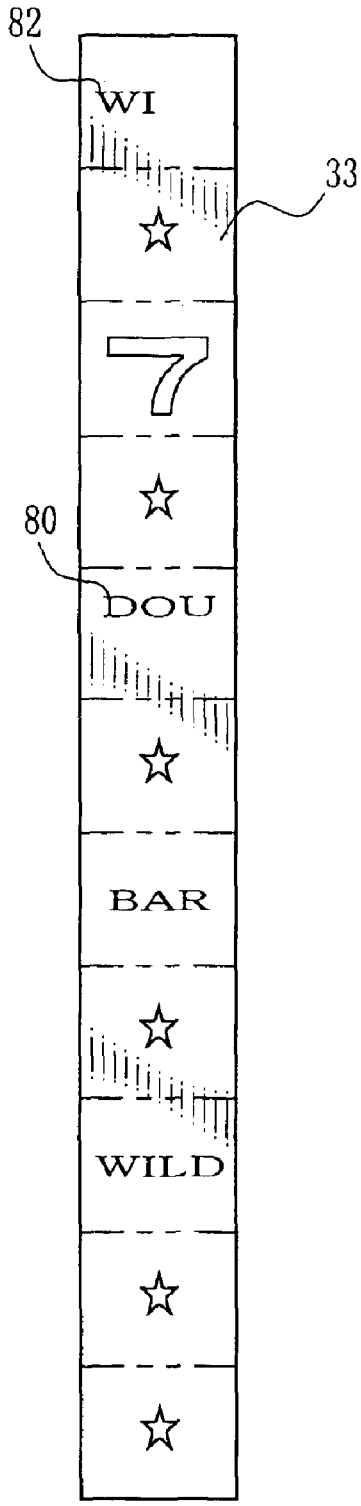
FIG. 4B is an expansion view of an inner symbol sheet.

Referring to FIGS. 4A and 4B, eleven symbols are painted in the inner symbol sheet 33. This slot machine 10 has five types of symbols. Hit symbols "7", "BAR", and "WILD", printed in the inner symbol sheet 33, form the winning symbol combinations.

"DOUBLE" is a composite symbol 34 (refer to FIG. 7) that is divided in two symbols. The first half, "DOU" 80, is printed in the inner symbol sheet 33, and the last half, "BLE" 81, is printed in the outer symbol sheet 32*a*. The symbol "WILD" is used as the composite symbol 34 too. Dividing the "WILD" in two, the first half, "WI" 82, is printed in the inner symbol sheet 33, and the last half, "LD" 83, is printed in the outer symbol sheet 32*a*. Individual half symbols 80 to 83 cannot compose a composed symbol by itself. However, when corresponding half symbols like "DOU" 80 and "BLE" 81, or "WI" 82 and "LD" 83 are overlapped with each other to display "DOUBLE" or "WILD" in the symbol display window 11, the half symbols 80 to 83 compose a hit symbol.

A star is a lost symbol which does not make up any winning symbol combination. The star is disposed between the two hit symbols.

The outer symbol sheet 32*a* has at least one group of three continuous blank symbols (three-symbol blank). Thus, when the outer reel 32 stops in such a position as to display the three-symbol blank through the symbol display window 11, only the symbols of the inner reel 31 are observable from outside.

The various types of symbols are arranged in the second and third reel units 15 and 16 too, but the types, number, and arrangement order of the symbols are changeable appropriately in each reel unit. Also it is possible to divide the composite symbols 34 in perpendicular half, in horizontal half, in oblique half, or in unequal size.

Attachment plates 36 and 37 are integrally formed with the inner and outer reels 31 and 32, respectively. The inner and outer reels 31 and 32 are connected to stepping motors 48 to 50 and 55 to 57 (refer to FIG. 5) via the attachment plates 36 and 37. Thus, the inner and outer reels 31 and 32 are independently rotated by the stepping motors 48 to 50 and 55 to 57.

Figure 5:
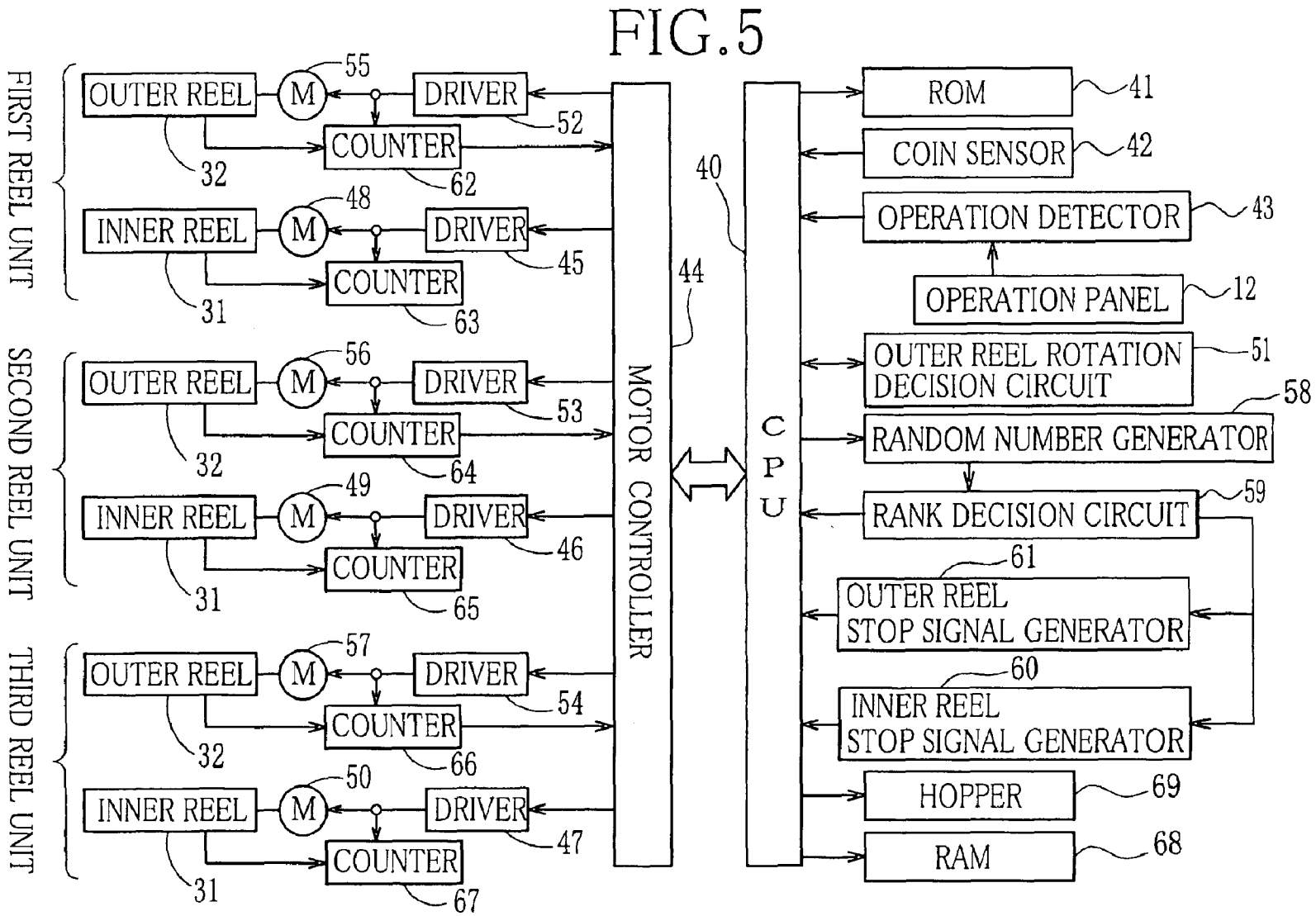
FIG. 5 is a block diagram showing electrical circuit in the slot machine.

Referring to FIG. 5, the slot machine 10 is activated when a CPU 40 loads an executive program of a slot game from a ROM 41. A coin sensor 42 provided at a back of the coin slot 18 outputs a coin detection signal to the CPU 40 whenever detecting proper insertion of the coin.

When the bet button is operated, an operation detector 43 sends an operation signal to the CPU 40. When the game start button is operated, a start signal is sent to the CPU 40. The CPU 40 activates a motor controller 44 in response to the start signal. The motor controller 44 supplies drive pulses to the stepping motors 48 to 50 via drivers 45 to 47, so that the inner reels 31 of the first, second, and third reel units 14 to 16 are rotated.

When the start signal is input, the CPU 40 activates an outer reel rotation decision circuit 51. The outer reel rotation decision circuit 51 includes a random number generator, a random number sampling circuit, and a rotation decision table. The outer reel rotation decision circuit 51 samples a single random number, and the random number is compared to the rotation decision table. According to this result, it is decided whether the outer reel 32 is allowed to rotate or not. When the rotation of the outer reel 32 is allowed, the CPU 40 drives the stepping motors 55 to 57 connected to the outer reels 32 of the first to third reel units 14 to 16 via drivers 52 to 54 after stops of the inner reels 31. So the outer reels 32 are rotated.

When the start signal is input, the CPU 40 activates another random number generator 58. The random number generator 58 samples a single random number, and the random number is input to a rank decision circuit 59. The rank decision circuit 59 carries out a winning decision lottery based on the random number to decide a win or loss in a just started game. When the win is decided, a rank of win is decided by the lottery too. The rank decision circuit 59 decides a type of symbols displayed on the effective winning line 17. After the winning decision lottery in the rank decision circuit 59, a winning decision signal corresponding to the rank of the win is sent to the CPU 40.

After the winning decision lottery, the CPU 40 activates an inner reel stop signal generator 60 in case the inner reels 31 are rotating, and an outer reel stop signal generator 61 in case the outer reels 32 are rotating.

The inner reel stop signal generator 60 and the outer reel stop signal generator 61 output the CPU 40 stop position signals which indicate stop positions in rotation of the stepping motors 48 to 50 and 55 to 57, so that the symbols in accordance with the results of the winning decision lottery stop on the winning lines 17. The stepping motors 48 to 50 and 55 to 57 rotate in steps of a predetermined angle according to the number of drive pulses input through the drivers 45 to 47 and 52 to 54.

The drive pulses are input to and counted by counters 62 to 67 besides being sent to the stepping motors 48 to 50 and 55 to 57. Each of the inner and outer reels 31 and 32 is provided with a guide mark for indicating a reference position, and photo interrupters observe the rotation of the inner and outer reels 31 and 32. Whenever the inner or outer reel 31 or 32 makes one rotation, the photo interrupter outputs a reset signal in order to reset a value counted in the counters 62 to 67. So, the values counted in the counters 62 to 67 indicate rotational positions of the inner and outer reels 31 and 32 within one rotation. Since the reference positions of the inner and outer reels 31 and 32, and the types and arrangement of the symbols are known in advance, it is possible to recognize the types of symbols displayed in the symbol display window 11 by means of observing the number of the drive pulses supplied to the stepping motors 48 to 50 and 55 to 57.

When a winning symbol combination is completed on the winning line 17, the CPU 40 refers to a prize coin number table stored on the ROM 41, and stores the number of prize coins corresponding to the rank of win on a RAM 68. In operating the payout button in the operation panel 12, a hopper 69 is activated and coins the number of which is stored on the RAM 68 are paid out to the outlet 13. The RAM 68 has an area for storing the number of bet coins, an area for storing the number of inserted coins, and the like, besides an area for storing the number of the prize coins. The RAM 68 is used as a memory which temporarily stores various data obtained during the game.

Now, operation of the slot machine 10 will be described. Before the game, only the symbols in the inner reels 31 are observable, because the outer reels 32 stop with the three-symbol blank displayed through the symbol display window 11. When a player inserts coins into the coin slot 18 and bets the coins by the bet button, the winning lines 17 become effective.

In operating the game start button in the operation panel 12, the CPU 40 drives the stepping motors 48 to 50 simultaneously through the motor controller 44, so that the inner reels 31 of the first, second, and third reel units 14 to 16 start rotating.

Also the CPU 40 activates the random number generator 58. The random number generator 58 samples and inputs a single random number to the rank decision circuit 59. Based on the random number, the rank decision circuit 59 decides a win or loss by the winning decision lottery. In the case of win, the rank of win and the type of symbols displayed on the winning line 17 are decided by the lottery too. Then, the outer reel rotation decision circuit 51 is activated to decide whether the outer reels 32 rotate or not by an outer reel rotation decision lottery.

Taking a case of loss in the winning decision lottery and also loss in the outer reel rotation decision lottery, the CPU 40 stops the inner reels 31 in such positions as not to complete any winning symbol combination in response to receiving the stop position signal from the inner reel stop signal generator 60. The CPU 40 stops the inner reels 31 in the order of the first reel unit 14, the second reel unit 15, and the third reel unit 16. All processes for one lost game are finished now.

Taking a case of win in the winning decision lottery but loss in the outer reel rotation decision lottery, the rank decision circuit 59 sends the winning decision signal to the inner reel stop signal generator 60. The winning decision signal includes information of the types of symbols and the winning line 17 on which the winning symbol combination is completed. The CPU 40, which receives the stop position signal from the inner reel stop signal generator 60, stops the inner reels 31 in such positions as to display the decided types of symbols. Then, the CPU 40 refers to the prize coin number table stored on the ROM 41 and stores the number of the prize coins corresponding to the rank of win on RAM 68. In operating the payout button, the hopper 69 is activated to pay out the coins the number of which is stored on the RAM 68 to the outlet 13.

Figures 6A, 6B, 6C:
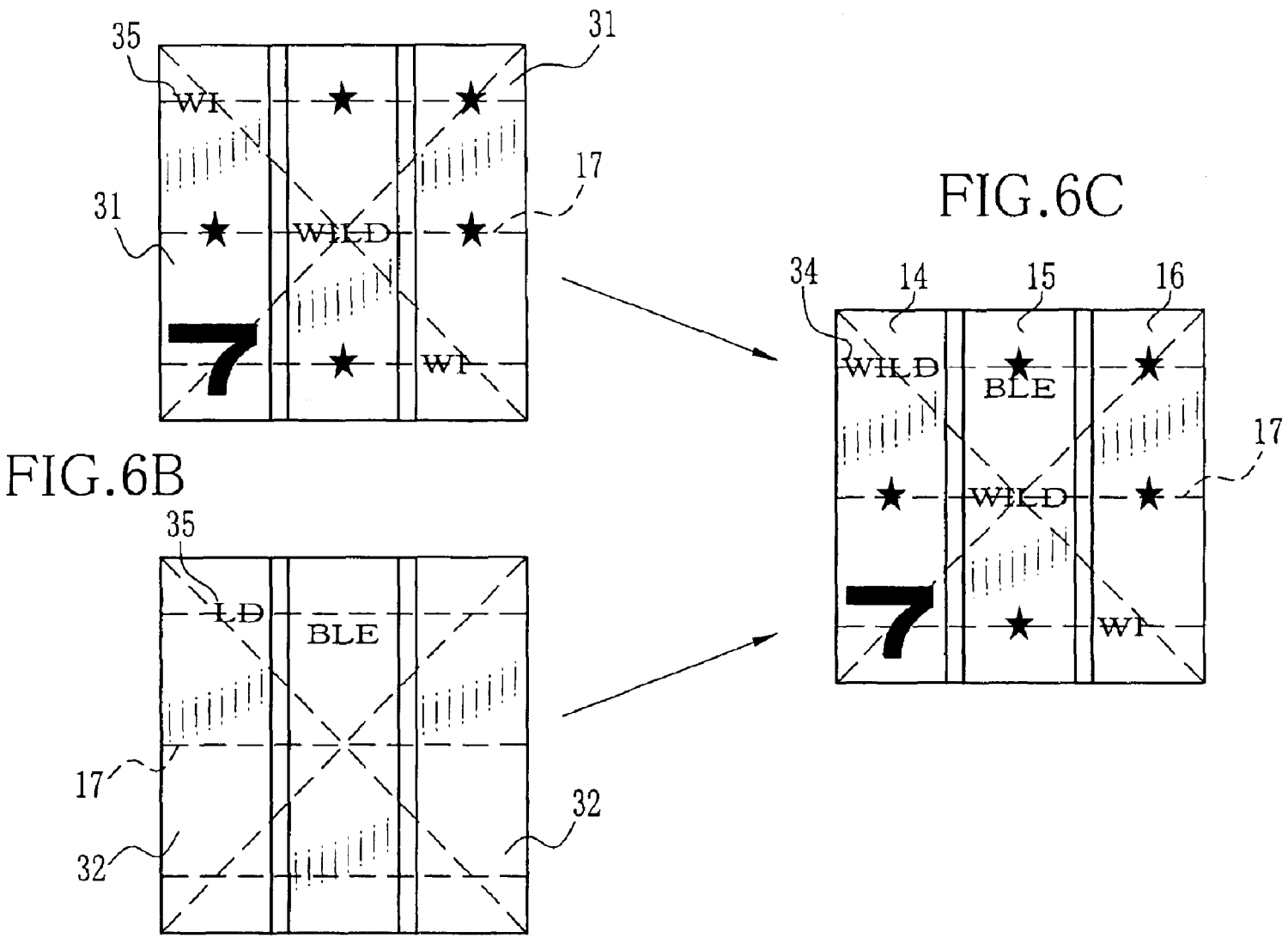
FIGS. 6A, 6B and 6C are front views of the symbol display apparatus showing an example of symbol combinations in a lost game.

Taking a case of loss in the winning decision lottery but win in the outer reel rotation decision lottery and displaying half symbols 35 of the inner and outer reels 31 and 32 through the symbol display window 11. Referring to FIGS. 6A, 6B and 6C, for example, the CPU 40 stops the inner reels 31 in such positions as to display the half symbols 35 ("WI" in the first reel unit 14 and "WI" in the third reel unit 16 in FIG. 6A). Then, the CPU 40 rotates the outer reels 32 of the first to third reel units 14 to 16 simultaneously by driving the stepping motors 55 to 57 through the motor controller 44. In response to the stop position signal from the outer reel stop signal generator 61, the CPU 40 stops the outer reels 32 in such positions as to display the half symbols 35 ("LD" in the first reel unit 14 and "BLE" in the second reel unit 15 in FIG. 6B). The CPU 40 stops the outer reels 32 in the order of the first reel unit 14, the second reel unit 15, and third reel unit 16. Whenever a single game ends, the outer reels 32 rotate again to stop at positions in which the three-symbol blanks are displayed through the symbol display window 11.

In this case, when the inner reels 31 stop, a symbol combination "WI"-"WILD"-"WI" including two half symbols 35, "WI", is displayed on the oblique winning line 17, so the player has great expectations for a win. After that, when the outer reels 32 of the first and second reel units 14 and 15 stop, a riichi situation occurs because of completion of the composite symbol 34 in the first reel unit 14. The riichi situation raises the player's expectations. However, when the outer reel 32 of the third reel unit 16 stops, the player lets the win slip away, because "LD", the half symbol 35, does not stop on a lower row and "WILD", the composite symbol 34, is not completed.

Because the slot machine 10 of this embodiment passes through more processes to reach the riichi situation like this, it is possible to effectively raise the player's expectations for the win than before. The high expectations cause great disappointment when the win slips away at the last process, and the disappointment raises expectations for the next game. In this way, it is possible to raise excitement of the game. In the above embodiment, the two reel units stop in the order of the first reel unit 14 and the second reel unit 15, but the both reel units may stop simultaneously. Also if each of the reel units stops in a small time difference, the riichi situation may not be emphasized.

Figures 7A, 7B, 7C:
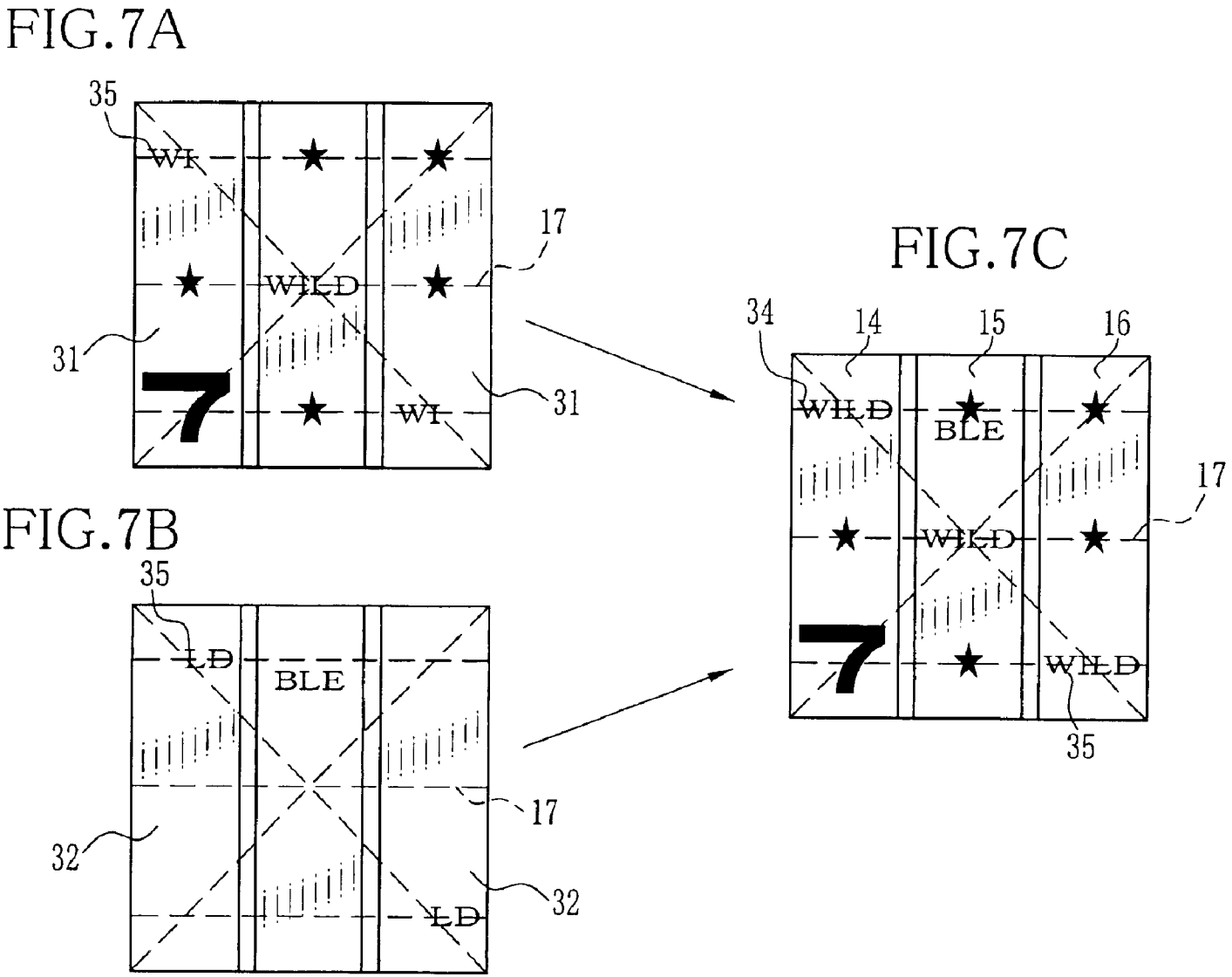
FIGS. 7A, 7B and 7C are front views of the symbol display apparatus showing an example of symbol combinations in a winning game.

Taking a case of wins in the winning decision lottery and in the outer reel rotation decision lottery, and displaying a winning symbol combination including the composite symbols 34. Referring to FIGS. 7A to 7C, for example, the CPU 40 stops the inner reels 31 in such positions to display the half symbols 35 ("WI" in the first reel unit 14 and "WI" in the third reel unit 16 in FIG. 7A). Then, the CPU 40 rotates the outer reels 32 of the first, second, and third reel units 14 to 16 by means of driving the stepping motors 55 to 57 simultaneously through the motor controller 44. In response to the stop position signal from the outer reel stop signal generator 61, the CPU 40 stops the outer reels 32 in such positions to display the half symbols 35 ("LD" in the first reel unit 14, "BLE" in the second reel unit 15, and "LD" in the third reel unit in FIG. 7B).

In this case, the half symbols 35, "WI" and "LD", form the composite symbol 34, "WILD", in an upper row of the first reel unit 14 and the lower row of the third reel unit 16. The winning symbol combination, "WILD"-"WILD"-"WILD", is displayed on the oblique winning line 17, so the game results in a win. The prize coins are paid out in winning, as being described before. Then, each of the outer reels 32 rotates again and stops in such a position as to display the three-symbol blank through the symbol display window 11, and the operation of a single game is ended.

The half symbols 35 may be displayed in the both inner and outer reels 31 and 32 regardless of a win or loss of a game. Or the half symbol 35 may be displayed in one of the inner or outer reel 31 or 32. There is a case in which a game results in a loss even if the composite symbol 34 is displayed. There is a case in which a winning symbol combination is completed by only the normal symbols, though the composite symbol 34 is displayed.

Figure 8A:
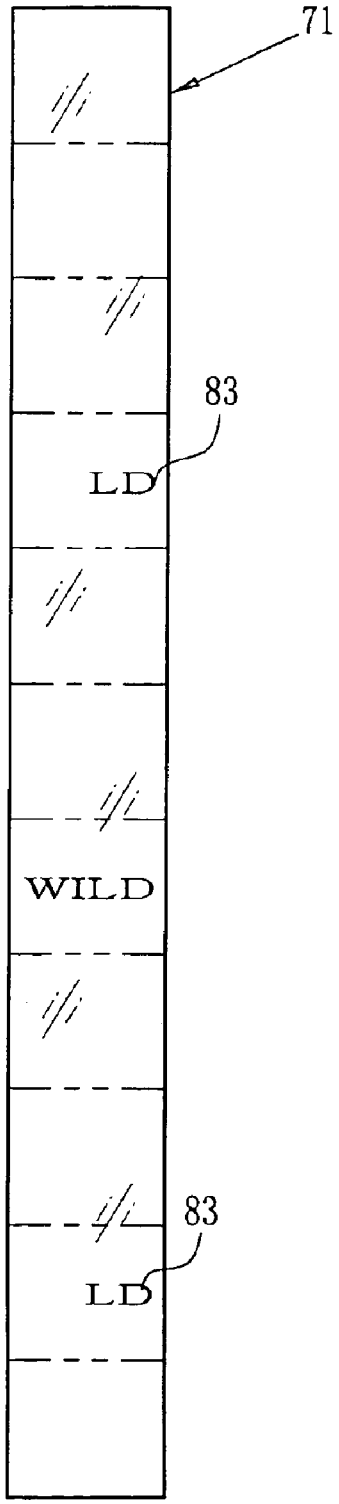
FIGS. 8A and 8B are expansion views of symbol sheets according to another embodiment.
Figure 8B:
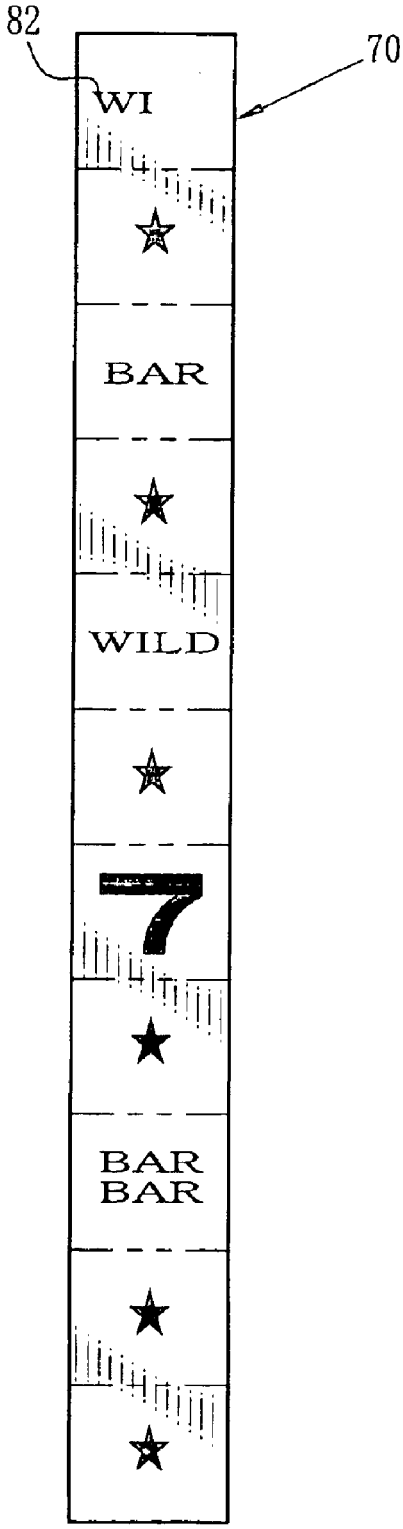

In the above embodiment, the outer reel 32 has only the half symbols 35, and the inner reel 31 has the complete symbols and half symbols. However, the types and number of symbols and how to arrange the symbols in the inner and outer reels 31 and 32 are changeable properly. As shown in FIGS. 8A and 8B, for example, it is possible to arrange the complete symbols and half symbols 35 in both of the inner symbol sheet 70 and the outer symbol sheet 71. The ranks of wins, the number of the prize coins, and the number and position of the winning lines 17 are properly changeable too.

In the above embodiment, a win or loss is decided first by the winning decision lottery based on the sampled random number, then each reel stops in such a position as to complete the symbol combination corresponding to the result. However, it may be possible to decide a symbol displayed by each reel (including the inner and outer reels 31 and 32) based on the sampled random number, then a win or loss is decided according to the symbol combination.

Figure 9:
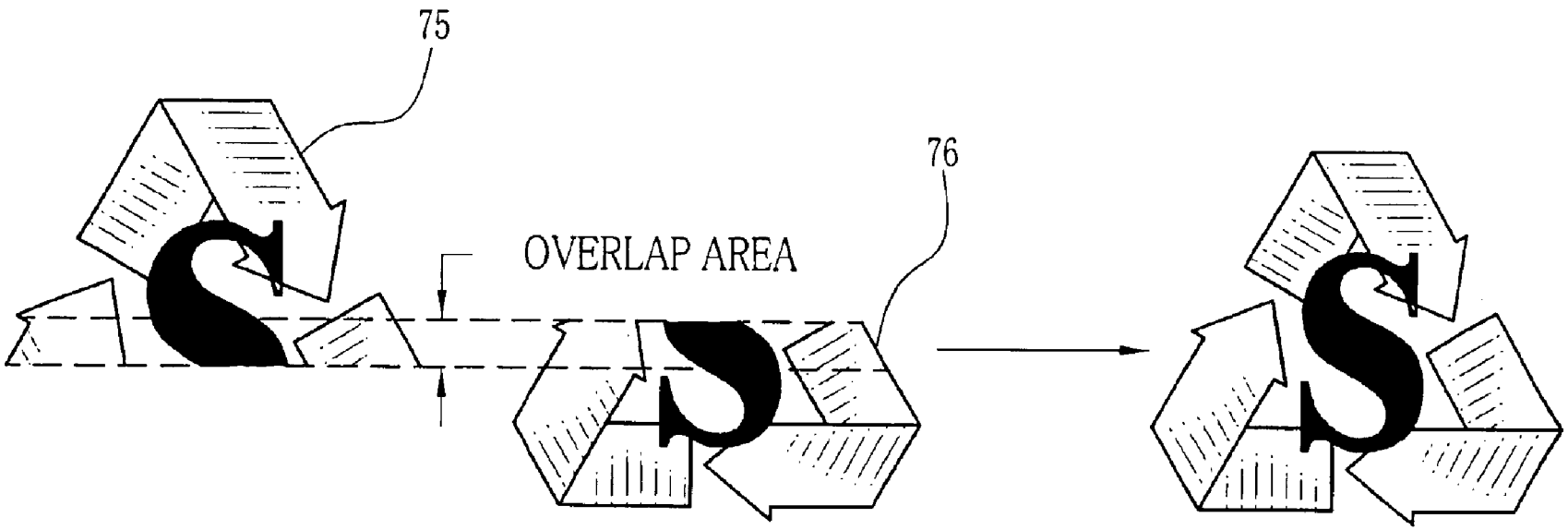
FIG. 9 is a front view of half symbols and a composite symbol according to further embodiment.

In the above embodiment, the two half symbols 35 are formed by dividing the complete symbol into exact halves. However, the half symbols 35 may make a gap between the two half symbols 35, when the half symbols 35 are displayed adjacently each other as the composite symbol 34. The gap spoils visual neatness of the composite symbol 34. Therefore, as shown in FIG. 9, it is preferable to divide a complete symbol in two half symbols 75 and 76 with an overlap area on which the half symbols 75 and 76 are overlapped each other. The inner reel 31 may carry the half symbol 75 a size of which is larger in a rotating direction of the reels than the half symbol 76 carried by the outer reel 32.

In the above embodiment, the inner and outer reels 31 and 32 have lengths of eleven symbols, but the lengths thereof are properly changeable. If the types of the symbols arranged in each reel are increased by means of enlarging diameters of the inner and outer reels 31 and 32, it is possible to increase variety of contents of the game.

In the above embodiment, the outer reels 32 rotate in a case of win in the outer reel rotation decision lottery. However, requirements for rotating the inner and outer reels 31 and 32, and timing and order of the rotation and stop are properly changeable. The outer reels 32 may rotate, for example, when the riichi situation occurs, or whenever the game is carried out, or when winning in the winning decision lottery. The inner reels 31 may rotate when a predetermined requirement is satisfied. If the outer reels 32 rotate too often the player's expectation may decrease, so it is preferable to rotate the outer reels 32 with a reasonable frequency which keeps the player's expectation for a win. The outer reels 32, in which the plural complete symbols are arranged, may rotate every game, and the inner reels 31 may rotate only when a predetermined requirement is satisfied. In this case, it is preferable to provide blanks in a row, the number of which is the same as the number of the symbols displayed through the symbol display window 11, in the inner reels 31, in order to clearly display the moving symbols of the outer reels 32.

In the above embodiment, no symbol is disposed in the blanks of the outer reel 32, but a symbol unused for any winning symbol combination may be disposed therein as a blank symbol. In this case, it is preferable to take a measure not to disturb visual recognition of the inner reels 31. As the measure, for example, the blank symbol may be formed smaller than the complete symbols, or the blank symbol may be disposed at the edge of the reel. The outer reels 32 may keep the symbols of a previous game displayed, instead of displaying the three-symbol blank before the game. In this case, the inner reels 31 stop at positions corresponding to a result of the winning decision lottery.

In the above embodiment, the number of the reel units is three, and every reel unit is a double reel having the inner reel 31 and the outer reel 32. However, the number of the reel units themselves and the number of the reel units adopting the double reel may be properly changed. Only one or two reel units may have a double reel, for example, and the other reel units may have a single reel. The inner and outer reels 31 and 32 of all reel units 14 to 16 may not necessarily rotate. It is possible, for example, to rotate both the inner and outer reels 31 and 32 only as to the reel unit 15. Also contents of the game using the inner and outer reels 31 and 32 may be changed properly. The symbol display apparatus according to the present invention is applicable to an upright pinball machine and other game machines, in addition to the slot machine.

Although the present invention has been described with respect to the preferred embodiments, the present invention is not to be limited to the above embodiments but, on the contrary, various modifications will be possible to those skilled in the art without departing from the scope of claims appended hereto.

What is claimed is:

1. A symbol display apparatus for a game machine, said game machine deciding a win or loss according to a combination of symbols lined up on a winning line across a symbol display window, said symbol display apparatus comprising:

plural reel units aligned across said winning line, at least one of said plural reel units having double reel structure, said double reel structure including an inner reel and an outer reel rotating concentrically and independently of each other;

a first half symbol and a second half symbol formed by dividing at least one of said symbols in two, said first half symbol being disposed in a periphery of said inner reel, said second half symbol being disposed in a periphery of said outer reel, said first half symbol and said second half symbol combining with each other on said winning line to form a composite symbol when said inner reel and said outer reel stop, wherein each of said first half symbol and said second half symbol is a lost symbol not making up any winning symbol combination, said composite symbol is a hit symbol making up said winning symbol combination.

2. A symbol display apparatus as recited in claim 1, wherein said symbol display apparatus has a first display condition completed following a rotation and a stop of one of said inner or outer reel, a second display condition completed following a rotation and a stop of the other one of said inner or outer reel after said first display condition, said win or loss is decided based on said second display condition.

3. A symbol display apparatus as recited in claim 1, wherein each of said first and second half symbols has an overlap area, and said overlap areas of said first and second half symbols are overlapped with each other in order to prevent a gap from being left between said first and second half symbols, when said first and second half symbols form said composite symbol.

4. A symbol display apparatus as recited in claim 3, wherein said first half symbol is larger than said second half symbol.

5. A symbol display apparatus as recited in claim 1, wherein said outer reel is provided with at least one blank space, said blank space has a size equal to the number of said symbols allowed to be displayed in said symbol display window at a time.

6. A symbol display apparatus for a game machine, said game machine deciding a win or loss according to a combination of symbols lined up on a winning line across a symbol display window, said symbol display apparatus comprising:

plural reel units aligned across said winning line, at least one of said plural reel units having double reel structure, said double reel structure including an inner reel and an outer reel rotating concentrically and independently of each other;

a first half symbol and a second half symbol formed by dividing at least one of said symbols substantially in equal halves along a longitudinal axis with respect to one of said plural reel units, said first half symbol being disposed in a periphery of said inner reel, said second half symbol being disposed in a periphery of said outer reel, said first half symbol and said second half symbol combining with each other on said winning line to form a composite symbol when said inner reel and said outer reel stop.

7. A symbol display apparatus for a game machine, said game machine deciding a win or loss according to a combination of symbols lined up on a winning line across a symbol display window, said symbol display apparatus comprising:

plural reel units aligned across said winning line, at least one of said plural reel units having double reel structure, said double reel structure including an inner reel and an outer reel rotating concentrically and independently of each other;

a first half symbol and a second half symbol formed by dividing at least one of said symbols substantially in equal halves, said first half symbol being disposed in a periphery of said inner reel, said second half symbol being disposed in a periphery of said outer reel, said first half symbol and said second half symbol statically combining with each other on said winning line to form a composite symbol when said inner reel and said outer reel stop.

8. Apparatus of claim 1, wherein the first half symbol is a left half portion of a first winning symbol and said second half symbol is a right half portion of the first winning symbol.

9. The apparatus of claim 1, wherein said first half symbol is an upper 50% of a first winning symbol and said second half symbol is lower 50% of the first winning symbol.

10. A symbol display apparatus for a game machine, said game machine deciding a win or loss according to a combination of symbols lined up on a winning line across a symbol display window, said symbol display apparatus comprising:

plural cylindrical reel units aligned across said winning line, at least one of said plural cylindrical reel units having a double reel structure, said double reel structure including a cylindrical inner reel and a cylindrical outer reel rotating concentrically and independently of each other;

a first half symbol and a second half symbol formed by dividing at least one of said symbols in two, said first half symbol being disposed on an exterior cylindrical surface of said cylindrical inner reel, said second half symbol being disposed on an exterior cylindrical surface of said cylindrical outer reel, said first half symbol and said second half symbol combining with each other on said winning line to form a composite symbol when said inner reel and said outer reel stop, wherein each of said first half symbol and said second half symbol is a symbol not making up any winning symbol combination, said composite symbol is a hit symbol denoting a winning symbol combination.

* * * * *